US008410413B2

(12) United States Patent
Johansson

(10) Patent No.: US 8,410,413 B2
(45) Date of Patent: Apr. 2, 2013

(54) METHOD OF VARYING FIRING RANGE AND EFFECT IN TARGET FOR SHELL AND SHELL CONFIGURED FOR THIS PURPOSE

(75) Inventor: Nils Johansson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 279 days.

(21) Appl. No.: 12/682,849

(22) PCT Filed: Oct. 16, 2008

(86) PCT No.: PCT/SE2008/000599

§ 371 (c)(1),
(2), (4) Date: May 18, 2010

(87) PCT Pub. No.: WO2009/051544

PCT Pub. Date: Apr. 23, 2009

(65) Prior Publication Data

US 2010/0224719 A1 Sep. 9, 2010

(30) Foreign Application Priority Data

Oct. 19, 2007 (SE) ..... 0702341-9

(51) Int. Cl.

| | |
|---|---|
| ***F42B 15/01*** | (2006.01) |
| ***F42B 15/10*** | (2006.01) |
| ***F42B 10/32*** | (2006.01) |
| *F42B 15/00* | (2006.01) |
| *F42B 10/00* | (2006.01) |

(52) U.S. Cl. ..... 244/3.22; 244/3.1; 244/3.15; 244/3.21; 102/374; 102/380; 102/473; 102/499

(58) Field of Classification Search ..... 89/1.11, 89/1.1; 244/3.1–3.3; 102/473, 501, 374, 102/377–384, 475, 476, 489, 499
See application file for complete search history.

(56) References Cited

U.S. PATENT DOCUMENTS

| | | | | | |
|---|---|---|---|---|---|
| 2,654,320 | A | * | 10/1953 | Schmid | 244/3.28 |
| 2,655,105 | A | * | 10/1953 | Hansche | 102/377 |
| 2,721,517 | A | * | 10/1955 | Workman | 102/377 |
| 3,124,072 | A | * | 3/1964 | Herrmann | 244/3.23 |
| 3,306,205 | A | | 2/1967 | Marcus et al. | |
| 3,613,617 | A | * | 10/1971 | Hamilton | 244/3.25 |
| 3,867,893 | A | * | 2/1975 | Saholt et al. | 244/3.25 |
| 3,995,549 | A | * | 12/1976 | Mullen, Jr. | 102/476 |
| 4,022,129 | A | * | 5/1977 | Day et al. | 102/378 |
| 4,348,957 | A | * | 9/1982 | White et al. | 102/378 |
| 4,406,210 | A | * | 9/1983 | Baker et al. | 102/379 |
| H0203 | H | | 2/1987 | Thomas et al. | |

(Continued)

FOREIGN PATENT DOCUMENTS

| | | |
|---|---|---|
| EP | 0790476 A2 | 8/1997 |
| EP | 1225327 A1 | 7/2002 |

*Primary Examiner* — Bernarr Gregory

(74) *Attorney, Agent, or Firm* — Novak Druce Connolly Bove + Quigg LLP

(57) ABSTRACT

The present invention relates to a method and a shell (1) for achieving variable firing range and effect when firing from a launcher, which shell (1) contains a firing charge (10), a rocket motor charge (6) with gas outlet (8), a rocket motor nozzle (9) and an active part (5). According to the invention, this is achieved by virtue of the fact that the shell (1) also contains a release mechanism (15) for releasing the rocket motor nozzle (9) from the rocket motor charge (6) after a time delay determined with regard to firing range and effect, and that the rocket motor charge (6) comprises a propellant which is detonable.

10 Claims, 2 Drawing Sheets

U.S. PATENT DOCUMENTS * cited by examiner

| | | | | |
|---|---|---|---|---|
| 5,141,175 | A * | 8/1992 | Harris | 244/3.25 |
| 5,619,010 | A * | 4/1997 | Holm et al. | 102/489 |
| 5,760,330 | A * | 6/1998 | Himmert et al. | 102/489 |
| 6,422,507 | B1 * | 7/2002 | Lipeles | 244/3.13 |
| 6,928,931 | B1 * | 8/2005 | Biserod | 102/377 |

METHOD OF VARYING FIRING RANGE AND EFFECT IN TARGET FOR SHELL AND SHELL CONFIGURED FOR THIS PURPOSE

CROSS REFERENCE TO RELATED APPLICATIONS

This application is a National Phase filing under 35 U.S.C. §371 of PCT/SE2008/000599 filed Oct. 16, 2008, which claims priority to Patent Application No. 0702341-9, filed in Sweden on Oct. 19, 2007. The entire contents of each of the above-applications are incorporated herein by reference.

TECHNICAL FIELD

The present invention relates to a method whereby variable firing range and effect is achieved with a shell fired from a launcher, which shell contains a firing charge whereby the shell is fired from the launcher, a rocket motor comprising a rocket motor charge a gas outlet and a rocket motor nozzle whereby the shell is propelled in a trajectory towards a target, and an active part which takes effect at the target, in which the firing charge is initiated by a first initiating device and in which the active part is initiated by a second initiating device, which second initiating device is activated by a programmable activating device. The invention also relates to a shell for achieving a variable firing range and effect.

BACKGROUND OF THE INVENTION

Shells of the said type, in which firing range and effect at the target can be varied have long been known. U.S. Pat. No. 3,306,205, FIG. 1, shows a fin-stabilized shell comprising a firing charge for firing the shell from a launcher, a rocket motor comprising a gas outlet and a rocket motor nozzle for propelling the shell in the trajectory, and an explosive charge for effect at the target. The firing range of the shell and the effect at the target can be varied by the choice of moment for initiation of the rocket motor. Early initiation means that the rocket motor propels the shell for a long period, allowing a long firing range. Late initiation means that the rocket motor propels the shell for a short period, implying a short firing range. The effect of the shell at the target is determined, in the first place, by the explosive effect of the explosive charge, but the final velocity of the shell, i.e. the velocity which the shell reaches at the target, also has an influence. High final velocity means high kinetic energy and high effect at the target, low final velocity means little kinetic energy and minor effect at the target. The rocket motor can thus be used firstly to propel the shell in the trajectory of the shell in order to vary the firing range, and secondly to increase the final velocity of the shell in the final phase of the trajectory and hence increase the effect of the shell at the target.

A drawback with the process is, however, that the rocket motor is not always put to optimum use with regard to firing range and effect. In the case of short firing ranges, when maximum effect at the target is sought and when only a part of the rocket motor is used, the process means that the unused part of the rocket motor is not utilized.

SUMMARY OF INVENTION

A first object of the present invention is to provide a method whereby variable firing range and effect at the target is achieved with a shell fired from a launcher, which shell contains a firing charge whereby the shell is fired from the launcher, a rocket motor comprising a rocket motor charge with a gas outlet and a rocket motor nozzle whereby the shell is propelled in a trajectory towards a target, and an active part, which takes effect at the target, in which the rocket motor charge is put to optimum use with regard to firing range and effect in the target and in which the rocket motor charge is always fully utilized in the propulsion of the shell and/or in the effect in the target.

A second object of the present invention is to provide a shell for achieving variable firing range and effect when fired from a launcher, which shell contains a firing charge for firing the shell from the launcher, a rocket motor comprising a rocket motor charge with a gas outlet and a rocket motor nozzle for propelling the shell in a trajectory towards a target, an active part for effect in the target, a first initiating device for initiating the firing charge, a second initiating device for initiating the active part, and a programmable activating device for activating the second initiating device, in which the rocket motor charge is put to optimum use with regard to firing range and the effect in the target and in which the rocket motor charge is always fully utilized in the propulsion of the shell and/or in the effect in the target.

These objects, as well as other objects not enumerated here, are satisfactorily met within the scope of that which is specified in the present independent patent claims. Embodiments of the invention are specified in the independent patent claims.

Thus, according to the present invention, a method of varying firing range and the effect at the target according to the first object has been realized, characterized in that the rocket motor charge contains a detonable propellant, which propellant is detonated in response to initiation of the active part, and in that the shell also contains a release mechanism, which releases the rocket motor nozzle or part of the rocket motor nozzle from the rocket motor, and in that the release mechanism is activated by the programmable activating device after a time delay determined with regard to firing range and effect.

According to further aspects of the method according to the invention:

- the firing charge of the shell is arranged in the rocket motor nozzle of the shell to facilitate handling of the shell in the automated ammunition handling system, since the otherwise occurring handling of cases for firing charges is no longer required,
- the rocket motor charge of the shell is initiated by the firing charge via the gas outlet of the rocket motor.

Furthermore, according to the present invention, a shell for variable firing range and effect according to the above-stated objects has been realized, characterized in that the rocket motor charge comprises a detonable propellant and in that the shell also contains a release mechanism for releasing the rocket motor nozzle or part of the rocket motor nozzle from the rocket motor, which release mechanism can be optionally activated by the programmable activating device after a time delay which is determinable with regard to firing range and effect at the target.

According to further aspects of the shell according to the invention:

- the firing charge of the shell is arranged in the rocket motor nozzle of the shell to facilitate handling of the shell in an automated ammunition handling system, since the otherwise occurring handling of cases for firing charges is no longer required,
- component parts of the shell, such as, for example, the percussion cap and the container of the rocket motor, are produced in combustible material to facilitate handling of the shell, the rocket motor charge of the shell is arranged such that it is initiated by the firing charge via the gas outlet of the rocket motor charge.

ADVANTAGES AND EFFECTS OF THE INVENTION

A shell fired from a launcher is therefore arranged such that the firing range and effect of the shell are adapted to a target by the rocket motor charge of the shell optionally being able to be shut off after a set time delay, and the rocket motor charge is arranged such that it can act as an explosive charge at the target. Hence, the rocket motor charge is always 100% utilized for propulsion and/or for effect.

Further advantages and effects will emerge from a study and consideration of the following detailed description of the invention, including a number of its advantageous embodiments, as well as the accompanying drawing figures. The method and the device according to the invention have been defined in the following patent claims.

BRIEF DESCRIPTION OF DRAWINGS

The invention will be described in greater detail below with reference to the appended figures, in which.

DESCRIPTION OF BEST AND VARIOUS EMBODIMENTS

Figure 1:
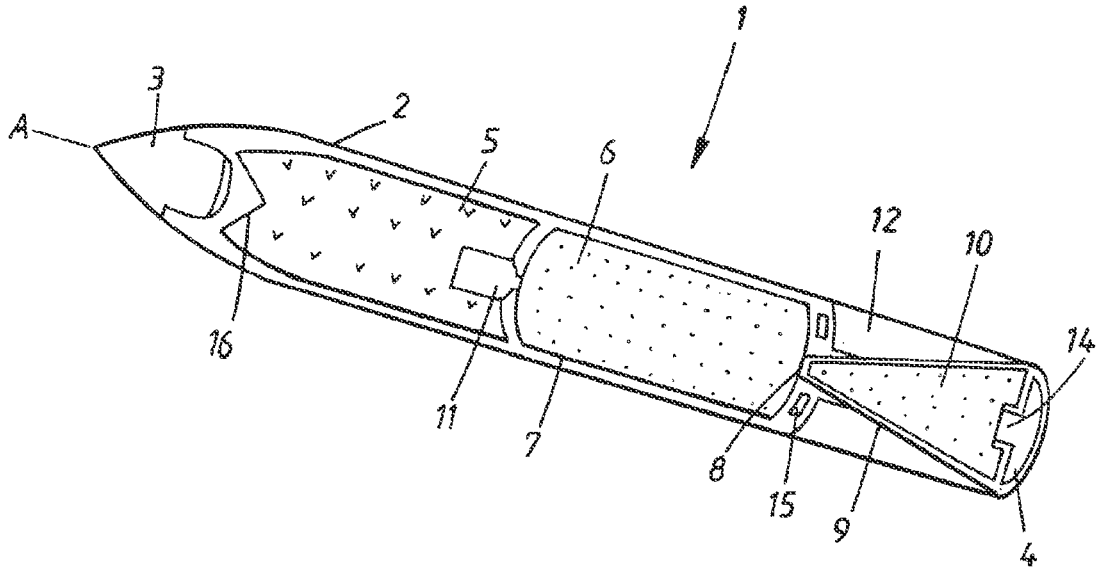
FIG. 1 shows a schematic longitudinal section of the shell according to the invention.
Figure 2:
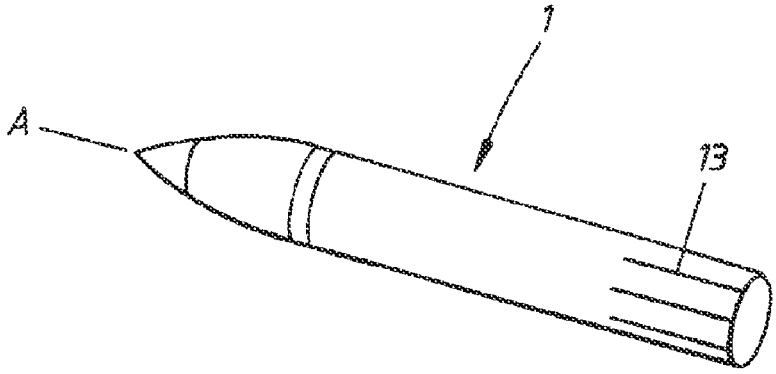
FIG. 2 shows a schematic side view of the shell prior to firing according to the invention.
Figure 3:
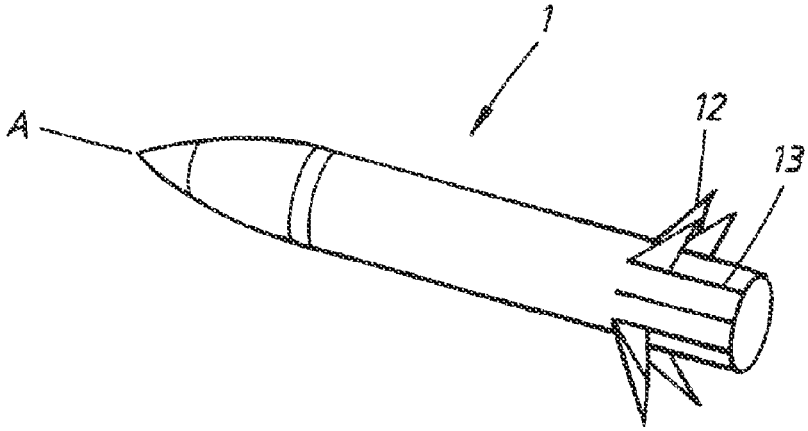
FIG. 3 shows a schematic side view of the shell following firing according to the invention.

FIG. 1 shows a preferred embodiment of the shell 1, according to the invention. The shell 1 comprises a shell body 2, on whose front part, in the direction of effect A of the shell, a programmable activating device 3, for example a programmable detonating fuse 3, is arranged, and on the rear part of which shell body 2 a base plate 4 is arranged. The shell body 2 comprises an active part 5 arranged behind the programmable detonating fuse 3, a rocket motor 7 comprising a rocket motor charge 6 with a gas outlet 8, and a rocket motor nozzle 9 (also referred to as a nozzle 9), as well as a firing charge 10 arranged in the rear part of the shell body 2, in front of the base plate 4. The shell 1 further comprises a first initiating device 14, for example an electric percussion cap 14 (also referred to as electric primer 14) for initiating the firing charge 10 of the shell 1, a second initiating device 11 (also referred to as a detonator 11) for initiating the active part 5 of the shell 1, as well as guide fins 12 arranged in the rear part of the shell body 1. The fins can be radially extensible via a number of oblong openings 13 (also referred to as slots 13) running longitudinally in the shell body 2, see especially FIGS. 2 and 3, which fins 12 are extended with the aid of a biased spring mechanism, which spring mechanism is activated after the shell 1 has been fired from the launcher. The firing charge 10 of the shell 1 is arranged inside the nozzle 9, preferably in a container, not shown, made of a combustible material. By utilizing the space inside the nozzle 9 for placement of the firing charge 10, a more compact embodiment of the shell 1 is enabled.

The shell 1 in FIG. 1 also comprises a release mechanism 15, which release mechanism 15, in response to an activating signal, releases or separates the nozzle 9, or part of the nozzle 9, from the rocket motor 7, resulting in a rapid drop in pressure in the rocket motor 7, which means that the combustion process in the rocket motor charge 6 is interrupted.

The release mechanism 15 in FIG. 1 comprises a pyrotechnic charge, not shown, which pyrotechnic charge is activated by the programmable detonating fuse 3. The pyrotechnic charge can expediently be comprised in one or more explosive bolts, not shown, arranged between the nozzle 9 and the rocket motor 7, so that the explosive bolts, upon activation, release the nozzle 9 or part of the nozzle 9 from the rocket motor 7. Alternatively, the pyrotechnic charge can be arranged in the form of a pyrotechnic cable wound around the nozzle 9 or part of the nozzle 9, not shown. In a third embodiment, not shown, the release mechanism 15 can comprise a purely mechanical arrangement, which mechanical arrangement comprises a biased spring mechanism arranged such that it is activated, for example at a predetermined gas pressure inside the rocket motor 7. In a fourth embodiment, not shown, the release mechanism 15 can comprise a pneumatically or electromagnetically controlled solenoid.

The shell body 2 in FIG. 1 constitutes the frame of the shell 1 and is configured to produce a splinter effect at the target. The active part 5 of the shell 1 is configured to produce pressure, fire and/or splinter effect at the target. The active part 5 is conventionally constructed, having one or more explosive sub-charges, not shown. The active part 5 preferably comprises one or more explosive charges comprising an explosive of the nitramine type, for example cyclotetramethylene tetranitramine (hexogen) or trimethyl trinitramine (octogen). Other types of explosive too can be embraced. To the explosive charge(s) one or more splinter-forming inlays 16 can also be provided, which splinter-forming inlays 16, typically, are configured for the achievement of a directed explosive action (DEA).

The rocket motor charge 6 of the shell 1 is configured, firstly, to act as a standard rocket motor 7 8 during the propulsion phase of the shell 1 and, secondly, to act as an extra explosive charge when the shell 1 reaches the target. The rocket motor charge 6 will thus burn as a gunpowder (deflagrate) during the propulsion, explode as an explosive (detonate) at the target. In order that the rocket motor charge 6 shall manage both tasks, it is required that the rocket motor charge comprises a propellant which can be made to detonate when it is subjected to a shock wave, for example when the active part 5 of the shell 1 or the detonator 11 detonates. Detonable propellants have long been known and preferably comprise one or more explosives of the nitramine type, for example cyclotetramethylene tetranitramine, and trimethyl trinitramine. Suitable propellant compositions comprise 60-70% by weight hexogen and/or octogen, 25-35% by weight bonding agent, preferably hydroxyl-linked polybutadiene, or a polymer of glycidyl nitrate or cellulose acetate butyrate, as well as miscellaneous additives up to 100% by weight, which miscellaneous additives comprise softeners, stabilizers and rate of burn catalysts. Alternatively, the propellant can exist in liquid and/or gaseous form, which liquid and/or gaseous propellant is detonable when subjected to detonation. Liquid and/or gaseous propellants place particular demands, however, upon the rocket motor 7 of the shell 1. Inter alia, the rocket motor 7 should be seal-tight to prevent leakage, withstand high gas pressures and comprise a valve arrangement which, upon activation, shuts off the gas outlet 8 from the rocket motor 7.

The shell 1 in FIG. 1 is preferably designed for firing with light low-recoil gun, for example an automatic motor-driven mortar gun. The shell 1 can be adapted, however, for firing in a high-recoil gun. The shell 1 is also especially suitable for automated ammunition-handling systems, which yields advantages in the form of rapid and simple handling of ammunition. The firing charge 10 of the shell 1 is arranged in the rocket motor nozzle 9 of the shell 1, which means that no cartridge case is required.

For the achievement of variable firing range, the shell contains a rocket motor charge 6 with optionally variable operating period. For control of the functions of the shell, information is transferred from the fire direction system of the firing device via the first initiating device 14 to the programmable detonating fuse 3 of the shell. Based on information from the fire direction system about the position and nature of the target (bunker, military vehicle, etc.), one or more time delays can be calculated and then programmed into the programmable detonating fuse 3. The time delays can relate to the time from firing of the shell 1 to initiation of the active part 5, and/or the time from firing of the shell 1 to initiation of the release mechanism 15, i.e. release of the nozzle 9 of the rocket motor 6 from the rocket motor 7 and shut-off of the rocket motor 7.

The shell 1 in FIG. 1 is adapted for 81 mm calibre, but the principle of the shell 1 means that it can be used in a wider calibre range, 60-120 mm. Component parts of the shell 1, such as, for example, the percussion cap 14, for the container (not shown) of the firing charge 10 and the rocket motor 7, can be realized in materials which are combustible. For stabilization of the shell 1 in the trajectory, fins 12 are arranged in the rear portion of the shell, which fins are automatically extended when the shell 1 is fired from the launcher, see especially FIGS. 2 and 3.

The rocket motor charge 6 is initiated/primed by the firing charge 10, broadly directly behind in the barrel of the launcher. The rocket motor charge 6 of the shell 1 can subsequently be optionally shut off with regard to firing range and effect.

In the case of direct firing at medium-range targets, the rocket motor charge 6 is shut off early, but the velocity is still sufficient for the shell 1 to reach the target. In longer-range firing, when artillery or mortar devices are used, the shell 1 is fired in high trajectories, the rocket motor charge 6 being shut off late or not at all in order for the shell to reach the target. By shutting off the rocket motor charge 6 at different moments, the trajectory of the shell 1 can therefore be varied.

If a plurality of shells 1 are fired, for example in sequence, from a barrel, the angle of elevation of the barrel and the rate of burn of the rocket motor can be altered in a predetermined manner between the firings, so that the shells 1 hit the target in a sequence or at one and the same moment. The percussion cap 14 of the shell 1 is initiated by the electric striking pin (not shown) of the launcher. At the same time as the percussion cap 14 initiates the firing charge 10, information is transferred electrically from the fire direction system of the launcher to the programmable activating device 3 of the shell 1. Other ways of transferring information to the programmable activating device 3 are naturally also possible, for example via a transponder in the shell 1, which communicates with the fire direction system.

The programmable activating device 3 controls the various functions of the shell 1 during the path of the shell 1 to the target and activates the detonator 11 at the target. The firing charge 10 drives the shell 1 out of the launcher at an exit velocity which has been chosen typically somewhere within the range 70-100 m/s. The combustion in the firing charge 10 starts in the rear part of the firing charge 10 at the percussion cap 14 and advances forwards in the firing direction A of the shell 1, whereafter the rocket motor charge 6 is initiated when the combustion the rocket motor charge 6 is interrupted via the gas outlet 8. The rocket motor charge 6 can be used according to a number of different function modes with regard to firing range and effect, some of which are described in examples 1-5 below.

Example 1

Indirect Firing at Short-Range Targets

In the case of indirect firing at short-range targets, targets which are hidden, for example, behind a house, the shell 1 is fired from the launcher, the rocket motor charge 6 being initiated by the firing charge 10.

Directly after the shell 1 has left the launcher, the release mechanism 15 is activated by the detonating fuse 3, whereupon the release mechanism 15 releases the nozzle 9 or part of the nozzle 9 from the rocket motor 7. The release causes a drop in pressure in the gas outlet 8 of the rocket motor 7, resulting in an interruption to the combustion of the rocket motor charge 6. The shell 1 continues towards the target without further acceleration and, when the shell 1 reaches the target, the detonator 11 is activated, whereupon the active part 5 detonates.

The detonation from the active part 5 is propagated to the rocket motor charge 6, whereupon unused propellant in the rocket motor charge 6 detonates. A large proportion of the propellant is unused, so that the contribution from the propellant to the effect at the target is high.

Example 2

Indirect Firing at Medium-Range Targets

In the case of indirect firing at medium-range targets, the shell 1 is fired from the launcher, the rocket motor charge 6 being initiated by the firing charge 10. The shell 1 accelerates to a predetermined velocity, which velocity is calculated by the fire direction system with regard to firing range and target and is programmed into the detonating fuse. The release mechanism 15 is activated by the programmable detonating fuse 3, whereupon the nozzle 9 or a part of the nozzle 9 is released, for example by being blasted away by the pyrotechnic charge, whereupon the combustion in the rocket motor charge 6 is interrupted. The shell 1 continues without further acceleration and, when the shell 1 reaches the target, the detonator 11 is activated, whereupon the active part 5 detonates. The detonation from the active part 5 in turn detonates the unused propellant in the rocket motor charge 6. A medium-sized proportion of the propellant is used up, so that the contribution from the propellant to the effect at the target is medium-high.

Example 3

Indirect Firing at Long-Range Targets

In the case of indirect firing at long-range targets, for example at targets behind a hill, the shell 1 is fired from the launcher, the rocket motor charge 6 being initiated by the firing charge 10. The rocket motor charge 6 accelerates the shell 1 to a velocity of about 300 m/s, the whole of the rocket motor charge 6 being used. After this, the shell 1 continues towards the target without accelerating and, when the shell 1 reaches the target, the detonator 10 is activated, which triggers the active part 5. No unused propellant is left in the rocket motor charge 6, so that the propellant makes no contribution to the effect at the target.

Example 4

Direct Firing at Short-Range Targets

In the case of direct firing at short-range targets, visible targets, the shell 1 is fired from the launcher, the rocket motor charge 6 being initiated by the firing charge 10. The rocket motor charge 6 accelerates the shell 1 right up to the target, but, since the distance is short, the rocket motor charge 6 has no time to be fully used up. When the explosive charge 5 detonates, the unused propellant in the rocket motor charge 6 will also therefore detonate, which gives the shell 1 increased effect at the target.

Example 5

Direct Firing at Long-Range Targets

In the case of direct firing at long-range targets, the shell 1 is fired from the launcher, the rocket motor charge 6 being initiated by the firing charge 10. The rocket motor charge 6 accelerates the shell 1 towards the target, the rocket motor charge 6 having no time to be fully used up before the shell 1 reaches its destination. When the explosive charge of the active part 5 detonates, no unused propellant is left in the rocket motor charge 6, so that the effect of the shell 1 is limited to the effect from the explosive charge 5.

The invention is not limited to the above described illustrative embodiments, but rather a number of alternative embodiments are accommodated within the scope of the appended patent claims. Thus, the active part of the shell can comprise more than two explosive sub-charges. The explosive sub-charges can also comprise splinter-forming inlays with different configuration for the realization of, for example, radial, projectile-shaped or spherical splinters. The explosive sub-charges can also be initiated in the reverse order, i.e. a rear explosive sub-charge is initiated before a front explosive sub-charge. It will further be appreciated that the explosive sub-charges can have different calibres, different geometries and, moreover, can contain different materials.

The invention claimed is:

1. Method whereby variable firing range and effect at the target is achieved with a shell fired from an automatic motor-driven gun with an automated ammunition handling system, which shell contains a firing charge whereby the shell is fired from the launcher, a rocket motor comprising a rocket motor charge with a gas outlet and a rocket motor nozzle whereby the shell is propelled in a trajectory towards a target, and an active part which takes effect at the target, in which the firing charge is initiated by a first initiating device and in which the active part is initiated by a second initiating device, which second initiating device is activated by a programmable activating device, wherein the rocket motor charge contains a detonable propellant, which propellant is detonated in response to initiation of the active part, and in that the shell also contains a release mechanism, which releases the rocket motor nozzle or part of the rocket motor nozzle from the rocket motor, and in that the release mechanism is activated by the programmable activating device after a time delay determined with regard to firing range and effect.

2. Method according to claim 1, wherein the firing charge of the shell is arranged in the rocket motor nozzle of the shell to facilitate handling of the shell in the automated ammunition handling system, since the otherwise occurring handling of cases for firing charges is no longer required.

3. Method according to claim 1, wherein the rocket motor charge of the shell is initiated by the firing charge via the gas outlet of the rocket motor charge.

4. Method according to claim 3, wherein the firing charge of the shell is arranged in the rocket motor nozzle of the shell to facilitate handling of the shell in an automated ammunition handling system, since the otherwise occurring handling of cases for firing charges is no longer required.

5. Method according to claim 3, wherein component parts of the shell are produced in combustible material to facilitate handling of the shell.

6. Method according to claim 5, wherein the rocket motor charge of the shell is arranged such that it is initiated by the firing charge via the gas outlet of the rocket motor charge.

7. Method according to claim 3, wherein the component parts of the shell are the percussion cap and the container of the rocket motor.

8. Shell for achieving a variable firing range and effect when fired from a launcher, which shell contains a firing charge for firing the shell from an automatic motor-driven gun with an automated ammunition handling system, a rocket motor comprising a rocket motor charge with a gas outlet and a rocket motor nozzle for propelling the shell in a trajectory towards a target, an active part for effect in the target, a first initiating device for initiating the firing charge, a second initiating device for initiating the active part, and a programmable activating device for activating the second initiating device wherein the rocket motor charge comprises a detonable propellant, and in that the shell also contains a release mechanism for releasing the rocket motor nozzle or part of the rocket motor nozzle from the rocket motor, which release mechanism is optionally activable by the programmable activating device after a time delay which is determinable with regard to firing range and effect at the target.

9. Shell according to claim 8, wherein component parts of the shell are produced in combustible material to facilitate handling of the shell.

10. Shell according to claim 8, wherein the component parts of the shell are the percussion cap and the container of the rocket motor.

* * * * *